US008348263B2

(12) United States Patent
Otani et al.

(10) Patent No.: US 8,348,263 B2
(45) Date of Patent: Jan. 8, 2013

(54) RECORDING MEDIUM STACKER AND RECORDING APPARATUS

(75) Inventors: Aya Otani, Matsumoto (JP); Shinichiro Yoshikawa, Matsumoto (JP); Satoshi Tamai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/102,547

(22) Filed: May 6, 2011

(65) Prior Publication Data

US 2011/0278789 A1 Nov. 17, 2011

(30) Foreign Application Priority Data

May 13, 2010 (JP) ..... 2010-111376

(51) Int. Cl.
*B65H 31/04* (2006.01)

(52) U.S. Cl. ..... 271/213; 271/207

(58) Field of Classification Search ..... 271/207, 271/213; 399/405; 400/625
See application file for complete search history.

(56) References Cited

U.S. PATENT DOCUMENTS

| | | | | |
|---|---|---|---|---|
| 6,231,043 | B1 | 5/2001 | James, III et al. | |
| 6,991,331 | B2 * | 1/2006 | Kagami et al. | 347/108 |
| 7,384,038 | B2 * | 6/2008 | Murai | 271/207 |

FOREIGN PATENT DOCUMENTS

| | | | |
|---|---|---|---|
| JP | 2002-356263 | A | 12/2002 |
| JP | 2003-095518 | A | 4/2003 |
| JP | 2003-524563 | A | 8/2003 |
| JP | 2005-205648 | A | 8/2005 |
| JP | 2008-303000 | A | 12/2008 |
| JP | 2009-286574 | A | 12/2009 |

* cited by examiner

*Primary Examiner* — Michael McCullough
(74) *Attorney, Agent, or Firm* — Workman Nydegger

(57) ABSTRACT

A first stacker is configured so that a support surface includes a base-side support surface that forms a planar shape on the base end side of the support surface and a leading edge-side support surface that forms a planar shape that tilts upward toward the leading edge. A second stacker is configured so that a support surface forms a planar shape, and is held in a tilted orientation during use so that the support surface of the second stacker continues to the leading edge of the second stacker in the same upward-tilted state with respect to the leading edge-side support surface of the first stacker.

6 Claims, 7 Drawing Sheets

RECORDING MEDIUM STACKER AND RECORDING APPARATUS

CROSS-REFERENCE TO RELATED APPLICATIONS

This application claims the benefit of priority to Japanese Patent Application No. 2010-111376, filed May 13, 2010, the contents of which are hereby incorporated by reference in their entirety.

BACKGROUND

1. Technical Field

The present invention relates to recording medium stackers that stack recording media discharged from a recording apparatus and recording apparatuses provided with such recording medium stackers.

2. Related Art

Recording apparatuses that record predetermined images (including text, graphics, and so on) by applying a recording agent (such as a liquid) onto a recording medium (such as paper) are known. Such recording apparatuses typically include recording medium stackers (called simply "stackers" hereinafter) that support and stack recording media discharged to the outside of the apparatus. In order to make this type of stacker more compact when the recording apparatus is not in use, a pull-out structure is employed, where the support surface that supports the discharged recording media is formed using multiple components and the surface area of the support surface is increased by pulling one of the components out from other components.

For example, JP-A-2003-95518 proposes a stacker in which an approximately horizontally-oriented support surface (stacker surface) is formed in a connected manner, where a first pull-out portion is pulled out from a stacker base portion and a second pull-out portion is pulled out from the first pull-out portion. According to this stacker, a discharged recording medium can be moved smoothly along the approximately horizontal support surface formed in a connected manner by the stacker base portion, the first pull-out portion, and the second pull-out portion.

However, because the stacker disclosed in JP-A-2003-95518 is formed so that the support surface extends in an approximately horizontal direction using the multiple components, there is a problem in that the footprint of the stacker in the horizontal direction increases when the stacker is in use. Accordingly, a configuration in which the support surface, which is formed in a connected manner in which one component is pulled out from another component, is slanted partway through has been recently proposed, as exemplified by the configuration disclosed in JP-A-2008-303000. In other words, the discharged paper stacker apparatus disclosed in JP-A-2008-303000 includes a leading end stacker that is pulled out from an intermediate stacker, at which point the tip area of the leading end stacker is held on the intermediate stacker in a raised, slanted orientation by a holding mechanism portion.

Incidentally, with the discharged paper stacker apparatus disclosed in JP-A-2008-303000, the support surface has a bent shape while the leading end stacker has been pulled out of the intermediate stacker and the tip area of the leading end stacker is held in the raised, slanted orientation. In other words, a joint between the two support surfaces is present at a delivery area, where the support surface of the intermediate stacker on the upstream side of the discharge direction leads into the support surface of the leading end stacker on the downstream side of the discharge direction, and the two support surfaces intersect at an angle. For this reason, when the leading edge of the recording medium that is moving along the support surface in order to be discharged advances over the joint at the delivery area, the recording medium makes contact with the support surface of the slanted leading end stacker at an angle, changes its direction of movement to follow the support surface, and then moves so as to be discharged. Accordingly, there is a risk of an increase in the resistance that accompanies the discharge movement, which leads to unstable discharges.

SUMMARY

An advantage of some aspects of the invention is to provide a recording medium stacker in a smaller size capable of stacking a discharged recording medium in a stable manner by moving the recording medium along a support surface of the recording medium stacker in a smooth manner, and to provide a recording apparatus provided with such a recording medium stacker.

A recording medium stacker according to an aspect of the invention supports and stacks a recording medium discharged from a recording apparatus, and includes: a first stack member provided with a first support surface capable of supporting the recording medium; and a second stack member that is stored within the first stack member and can be pulled out of and pushed into the first stack member, and that is provided with a second support surface capable of supporting the recording medium when the second stack member has been pulled out of the first stack member and is in use. The first stack member has: a base end support surface in which the first support surface has a planar shape at the base end of the first stack member in the pull-out direction of the second stack member; and a leading end support surface that is formed continuing to the leading end from the base end support surface so as to form a planar shape in which the leading end of the first stack member in the pull-out direction is sloped upward. The second stack member is held in a tilted orientation in which the second support surface forms a planar shape, and when in use, continues to the leading end of the second support surface in a tilted state with the same upward slope as the leading end support surface of the first support surface.

According to this configuration, during use, when the second stack member is pulled out from the first stack member, the second stack member is held in an orientation that is tilted relative to the first stack member, and thus the footprint in the horizontal direction can be reduced. Furthermore, during use, even if the leading end support surface of the first support surface in the first stack member and the second support surface in the second stack member form, for example, a delivery area having a joint, the support surfaces do not intersect with each other at an angle at that delivery area; instead, the support surfaces form a connection that extends within the same plane. On the other hand, even if the base end support surface and the leading end support surface of the first support surface in the first stack member form, for example, a delivery area in which those support surfaces intersect at an angle, those support surfaces are connected in a continuous curved manner, rather than a joint being formed between the two surfaces at the delivery area. Accordingly, the discharged recording medium moves without any increase in resistance at the delivery area at which the leading edge of the recording medium moves from the base end support surface to the leading end support surface in the first support surface of the first stack member and at the delivery area at which the leading edge of the recording medium moves from the leading end support surface to the second support surface of the second stack member. Accordingly, the discharged recording medium can be stacked in a stable manner by causing the recording medium to move along the support surfaces of the recording medium stacker in a smooth manner, while also achieving a reduction in size.

A recording medium stacker according to another aspect of the invention further includes a holding mechanism portion that holds the second stack member in the tilted orientation when in use; the holding mechanism portion is provided within a spatial region that, when the first stack member is viewed from above, is located within the outer boundaries of the first stack member and between an imaginary plane that contains a base surface parallel to the base end support surface and an imaginary plane that contains the leading end support surface.

According to this configuration, the holding mechanism portion is formed within a spatial region that, when the first stack member is viewed from above, is located within the outer boundaries of the first stack member and between an imaginary plane that contains the base surface in the first stack member and a tilted imaginary plane that contains the leading end support surface; therefore, the holding mechanism portion does not protrude downward further than the base surface of the first stack member. Accordingly, in the case where the configuration is such that the first stack member is capable of being pulled out from the recording apparatus and pushed into and stored within the recording apparatus, there is no risk that the holding mechanism portion will catch when the first stack member is being pulled out or pushed in.

A recording medium stacker according to another aspect of the invention further includes a third stack member, having a plane-shaped third support surface that is smaller than the second support surface of the second stack member, provided so as to be pivotable, relative to the second stack member and central to the leading end of the second stack member, between a stored orientation in which the third support surface follows the second support surface and an opened orientation in which the third support surface continues to the leading end of the third support surface, and has a steeper slope than the second support surface. When the third stack member is in the opened orientation and the second stack member is stored within the first stack member, the third stack member continues to the leading end of the support surface of the third stack member in a tilted orientation in which the third surface is at the same upward slope toward the leading edge as the leading end support surface of the first support surface of the first stack member.

According to this configuration, in a state in which, for example, the second stack member is pushed into and stored within the first stack member with the third stack member in the opened orientation on the leading end thereof, the discharged recording medium is supported by the first support surface of the first stack member and the third support surface of the third stack member. Accordingly, in the case where the planar size of the discharged recording medium is small, the recording medium can be stacked in a stable manner while using a small footprint in the pull-out direction in accordance with that planar size.

In a recording medium stacker according to another aspect of the invention, the leading end support surface is formed more front side in the discharge direction of the recording medium than the base end support surface.

According to this configuration, the discharge speed of the recording medium is reduced by the support surfaces that are tilted upward in the discharge direction, which makes it possible to stack the recording medium in a stable manner.

A recording apparatus according to another aspect of the invention includes a recording unit that records onto a recording medium; a discharge unit that discharges the recording medium that has been recorded onto; and a recording medium stacker configured as described above.

According to this configuration, it is possible to achieve the same effects as those achieved by the recording medium stacker configured as described above.

BRIEF DESCRIPTION OF THE DRAWINGS

The invention will be described with reference to the accompanying drawings, wherein like numbers reference like elements.

FIG. 3A is a perspective view from below, and FIG. 3B is a partial bottom view seen from below the circular dash-line area indicated by the arrow IIIB in FIG. 3A.

FIG. 4A is a perspective view from above, and FIG. 4B is a cross-sectional view taken along the IVB-IVB line in FIG. 4A.

FIG. 5A is a plan view of a stacker, FIG. 5B is a cross-sectional view taken along the VB-VB line in FIG. 5A, FIG. 5C is a cross-sectional view taken along the VC-VC line in FIG. 5A, and FIG. 5D is a partial bottom view seen from below the oval dash-line area indicated by the arrow VD in FIG. 5A.

FIG. 6A is a plan view of a stacker according to the second embodiment seen from above, whereas

DESCRIPTION OF EXEMPLARY EMBODIMENTS

Hereinafter, an ink jet printer (also called simply a "printer" hereinafter), which is one type of a recording apparatus provided with a recording medium stacker, that embodies the invention will be described using the drawings. Note that in the following embodiments, the descriptions will be given assuming that the gravitational direction is the downward direction, the direction opposite to the gravitational direction is the upward direction, the pull-out direction of the stacker is the forward direction, the push-in direction of the stacker is the backward direction, and the direction horizontally orthogonal to the pull-out direction of the stacker is the horizontal direction/width direction.

First Embodiment

Figure 1:
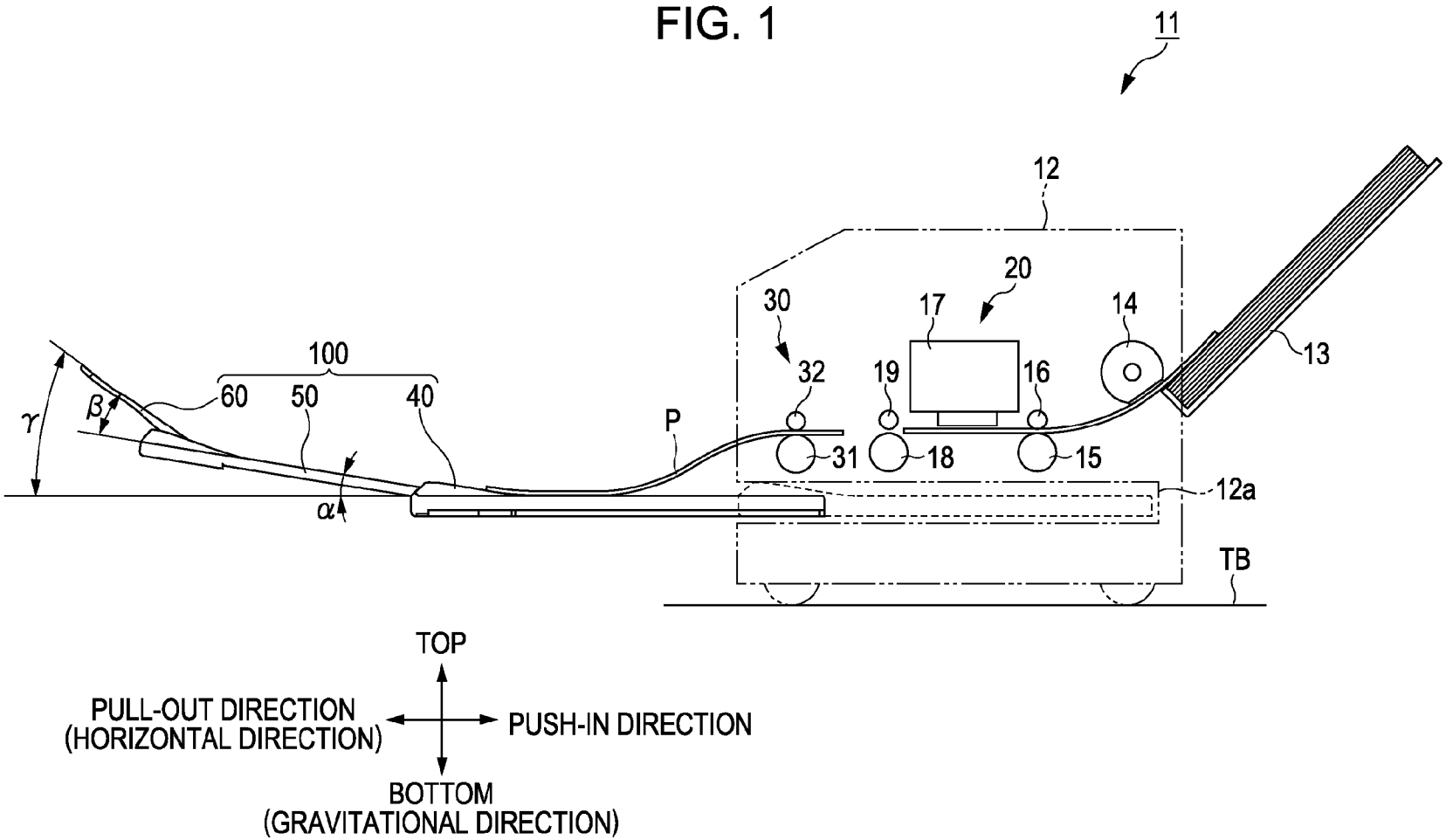
FIG. 1 is a schematic view illustrating the overall configuration of a printer according to a first embodiment.

As shown in FIG. 1, a printer 11 according to this embodiment has an approximately box-shaped casing 12. A recording unit 20 that records a predetermined image onto paper P serving as a recording medium by ejecting ink serving as a liquid, and a discharge unit 30 that discharges the paper P that has passed through the recording unit 20 to the outside of the casing 12, are provided within the casing 12. Furthermore, a paper supply tray 13 is provided in a tilted state on the outside of the casing 12.

The paper P is gathered in a stacked state in the paper supply tray 13, and the paper P is supplied to the recording unit 20 within the casing 12, one sheet at a time, by a supply roller 14 that is rotationally driven by a driving unit (not shown).

The recording unit 20 includes a recording head 17 that ejects ink onto the paper P, a paper feed roller 15, a slave roller 16, a discharge roller 18, and a slave roller 19. Note that a platen (not shown), serving as a support platform for the paper P onto which ink has been ejected, is provided below the recording head 17. The paper feed roller 15 is rotationally driven by a driving unit (not shown), and pinches the paper P supplied from the paper supply tray 13 with the slave roller 16, transporting the paper P between the recording head 17 and the platen.

The recording head 17 forms an image by ejecting ink onto predetermined locations on the paper P that has been transported upon the platen by the paper feed roller 15. Note that the recording head 17 ejects ink while moving back and forth in the width direction of the paper P that intersects with the transport direction of the paper P (that is, the direction that is orthogonal to the paper surface in FIG. 1), or ejects ink in a state in which the recording head 17 does not move and is instead provided so as to span the entire width of the paper P in the width direction of the paper P. Furthermore, the paper P is transported continuously or intermittently in the downstream direction, which is the direction of the discharge unit 30, in accordance with the ejection of the ink from the recording head 17.

The discharge roller 18 is also rotationally driven by a driving unit (not shown), and transports the paper P toward the discharge unit 30 by pinching the paper P that has passed between the recording head 17 and the platen with the slave roller 19.

The discharge unit 30 includes a discharge roller 31 and a slave roller 32. The discharge roller 31, which is rotationally driven by a driving unit (not shown), pinches, with the slave roller 32, the paper P transported by the rotational driving of the discharge roller 18, and discharges the paper P to the outside of the casing 12.

The printer 11 is provided with a stacker (recording medium stacker) 100 that holds and stacks the discharged paper P. The stacker 100 includes a first stacker 40 serving as a first stack member, a second stacker 50 serving as a second stack member, and a third stacker 60 serving as a third stack member. The third stacker 60 is provided so as to be capable of being stored within the second stacker 50, and the second stacker 50 is provided so as to be capable of being stored within the first stacker 40. Finally, the first stacker 40 is provided so as to be capable of being stored within a storage unit 12*a* of the printer 11, in a state in which the third stacker 60 is stored within the second stacker 50 and the second stacker 50 is stored within the first stacker 40.

The storage unit 12*a* is provided in a location corresponding to the bottom side of the casing 12 when the printer 11 has been placed on a placement platform TB such as a table, and is provided so that a storage space for storing the stacker 100 is approximately parallel to the bottom of the casing 12. Furthermore, a slide mechanism (not shown) is provided within the storage space of the storage unit 12*a*, and the slide mechanism can be used to pull the stacker 100 (the first stacker 40) forward from the storage unit 12*a*, which is the pull-out direction, as well as to push the stacker 100 (the first stacker 40) backward from that position, which is the push-in direction. Normally, the stacker 100 is stored within the storage unit 12*a* when not in use.

When the stacker 100 is in use, where the paper P is being stacked, first, the first stacker 40 is pulled out from the storage unit 12*a* in the forward direction, which corresponds to the discharge direction of the paper P, thus forming a first support surface SP1 (see FIG. 2) capable of supporting the paper P in front of the discharge unit 30. Next, the second stacker 50 is pulled out from the first stacker 40 in the forward direction, thus forming a second support surface SP2 that continues from the first support surface SP1. At this time, when the second stacker 50 has been pulled out from the first stacker 40, the second stacker 50 is held in a tilted orientation, in which the leading end of the second support surface SP2 is tilted upward by a holding mechanism portion HK (see FIGS. 5B and 5C), mentioned later. Furthermore, the third stacker 60 forms a third support surface SP3, which is tilted upward from the leading edge of the second stacker 50, by rotating the third stacker 60 central to the leading edge (front edge portion) of the second stacker 50.

In this embodiment, as shown in FIG. 1, an angle $\alpha$ for the upward slope that reduces the discharge speed of the paper P is formed between a base-side support surface SP1*a* in the first support surface SP1 of the first stacker 40 (see FIG. 2A) and the second support surface SP2 of the second stacker 50 (see FIG. 2A). Likewise, an angle $\beta$ for the upward slope that reduces the discharge speed of the paper P is formed between the second support surface SP2 of the second stacker 50 and the third support surface SP3 of the third stacker 60 (see FIG. 2A). As a result, an angle $\gamma$ ($=\alpha+\beta$) that is greater than the angle $\alpha$ is formed between the base-side support surface SP1*a* of the first support surface SP1 in the first stacker 40 that is furthest toward the base in the discharge direction of the paper P, and the third support surface SP3 of the third stacker 60 that is located furthest toward the leading edge. Accordingly, with the stacker 100 according to this embodiment, the multiple support surfaces SP1 (SP1*a*, SP1*b*), SP2, and SP3 are formed so that support surfaces that are tilted in a progressive manner are connected in the pull-out direction of the stacker 100, which is also the discharge direction of the paper P.

Furthermore, in this embodiment, the storage unit 12*a* is provided so as to be approximately parallel to the bottom surface of the casing 12 in the printer 11. Normally, the printer 11 is installed in a state in which the bottom surface of the casing 12 is approximately horizontal, and by doing so, the storage space within the storage unit 12*a* extends along an approximately horizontal direction. As a result, the pull-out direction of the first stacker 40 that is pulled out from the storage unit 12*a* is an approximately horizontal direction, and thus the base-side support surface SP1*a* of the first support surface SP1 that initially supports the discharged paper P follows the horizontal direction.

Figure 2:
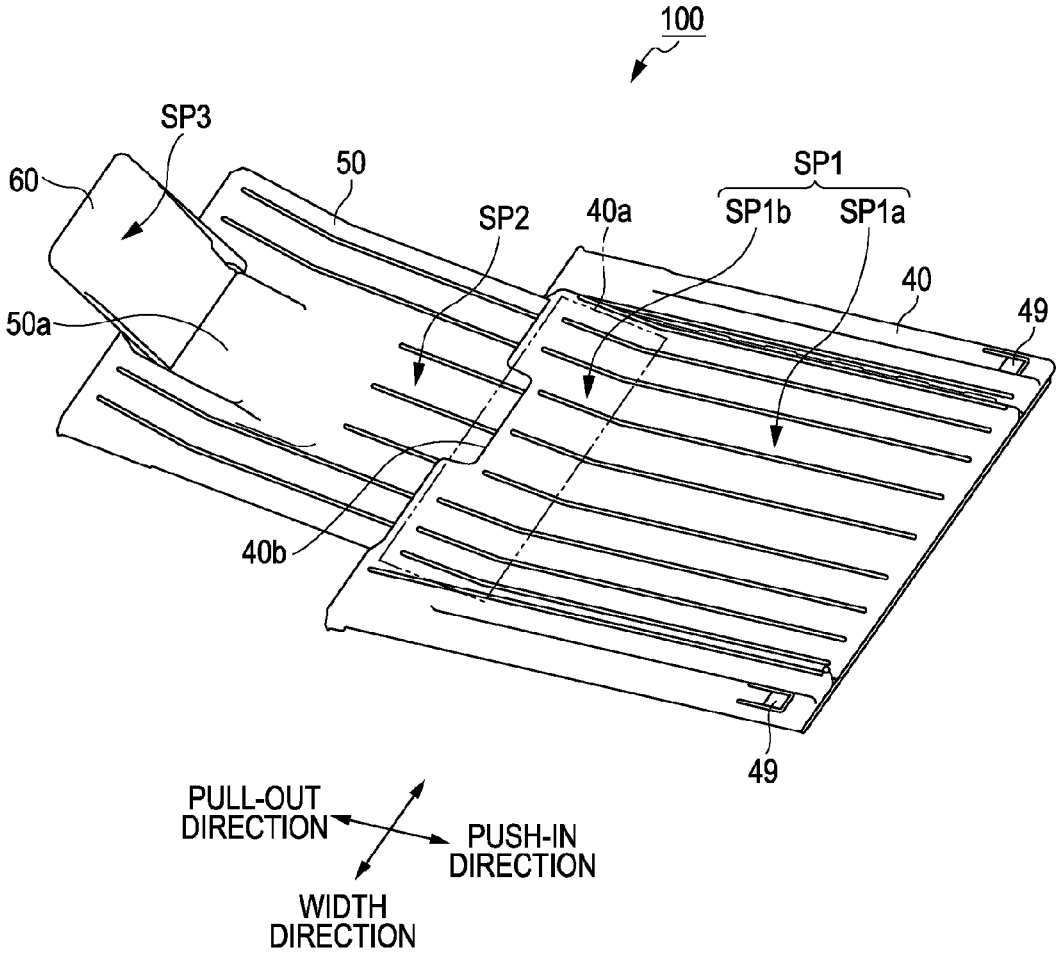
FIG. 2 is a perspective view illustrating a recording medium stacker according to an embodiment.

Next, the structure of the stacker 100 according to this embodiment will be described in detail with reference to the drawings. FIG. 2 is a perspective view illustrating a state in which the stacker 100 is in use, or in other words, in which the first stacker 40, the second stacker 50, and the third stacker 60, each of which has an approximately square shape when viewed from above, have been completely pulled out from the storage unit 12*a*. Note that the casing 12 and the paper supply tray 13 have been omitted from this diagram.

As shown in FIG. 2, the first support surface SP1, which is capable of supporting the paper P, is provided on the top surface of the first stacker 40. This first support surface SP1 is configured so as to include the base-side support surface SP1*a*, which forms a planar shape at the base end of the first stacker 40 in the pull-out direction, and a leading edge-side support surface SP1*b*, which forms a planar shape whose leading edge in the pull-out direction is raised upward. In the first support surface SP1 of the first stacker 40, the base-side support surface SP1*a* is formed as the primary planar surface, spanning in the pull-out direction, that initially supports the discharged paper P. Likewise, the leading edge-side support surface SP1*b* is formed so as to have approximately the same width of the base-side support surface SP1*a* at a forward region 40*a* of the first stacker 40 that is forward in the pull-out direction, and is formed so as to connect smoothly to the leading end of the base-side support surface SP1*a* by the forward region 40*a* tilting upward relative to the pull-out direction. In other words, the base-side support surface SP1*a* and the leading edge-side support surface SP1*b* in the first support surface SP1 form a delivery area that intersects with the angle $\alpha$; however, there is no joint in the delivery area, and a radial curve is provided instead, with the two support surfaces SP1*a* and SP1*b* being smoothly connected so as to form a connected curved support surface.

As shown in FIG. 2, a cut-out 40*b* for making it easier to pull out the second stacker is formed in the middle of the width direction of the end of the first stacker 40 in the pull-out direction. Furthermore, surfaces that are slightly lower than the base-side support surface SP1*a* in the downward direction, which is the thickness direction or the vertical direction, are formed on both sides of the first stacker 40 in the width direction thereof that intersects with the pull-out direction, in order to increase the torsional strength of the first stacker 40. Meanwhile, stoppers 49 that regulate the movement of the first stacker 40 in the pull-out direction by interlocking with projections (not shown) provided within the storage unit 12*a*, so that the first stacker 40 cannot pull out completely from the storage unit 12*a* of the printer 11, are formed in these lower surfaces on the opposite end in the pull-out direction. As shown in FIG. 2, on the respective surfaces of at least the base-side support surface SP1*a* and the leading edge-side support surface SP1*b* of the first support surface SP1 according to this embodiment, multiple band-shaped ribs that protrude slightly from the surfaces are formed so as to extend in lengthwise in the pull-out direction and at predetermined intervals in the width direction, in order to reduce friction with the paper P that moves along the first support surface SP1.

Meanwhile, as shown in FIG. 2, the second support surface SP2, which supports the paper P, is provided in the pulled-out second stacker 50. This second support surface SP2 is formed as the main planar surface of the second stacker 50 in the pull-out direction. Furthermore, in this embodiment, the holding mechanism portion HK, which holds the second stacker 50 in a tilted orientation, is provided so that when the second stacker 50 has been pulled out from the first stacker 40, the leading edge-side support surface SP1*b* of the first support surface SP1 and the second support surface SP2 are approximately parallel, or in other words, so that the two surfaces extend in the same direction and form what is essentially the same planar surface.

Furthermore, a storage depression 50*a*, into which the third stacker 60 is folded in an overlapping state, is provided in the second stacker 50, in a forward region in the pull-out direction thereof and in the center in the width direction thereof. Shaft holes 50*d* for axially supporting shaft portions (not shown) protruding outward in the width direction from both sides of the base portion of the third stacker 60 in a freely-pivotable state are formed on the respective inner side surfaces of the storage depression 50*a* on both sides thereof in the width direction. By pivoting the third stacker 60 from the stored orientation, in which the third stacker 60 overlaps with the second stacker 50, in an opening direction (rotation in the clockwise direction shown in FIG. 1), so that the third support surface SP3 in the storage depression 50*a* follows the second support surface SP2, the third stacker 60 is pulled out into an opened orientation in which the leading end thereof tilts upward, as shown in FIG. 1 and FIG. 2. When the third stacker 60 has been pulled out to the opened orientation in this manner, the third support surface SP3, which has a narrower surface in the width direction than the second support surface SP2, forms a connection with the second support surface SP2 in which the third support surface SP3 is tilted further upward, relative to the second support surface SP2, toward the front of the discharge direction of the paper P.

Note that the forward region of the second stacker 50 in the pull-out direction is formed so that the surface thereof has a tilted surface, tilted upward slightly more than the second support surface SP2 relative to the pull-out direction, in order to add to the structural strength of the second stacker 50 and form a structure in which the third stacker 60 can be stored by pivoting the third stacker 60. However, note that this tilted surface is formed so that when the second stacker 50 is pushed into and stored within the first stacker 40, the tilted surface does not interfere with the bottom surface of the first stacker 40 that opposes the second stacker 50. Furthermore, as shown in FIG. 2, in this embodiment, on the surface of the second support surface SP2 aside from the storage depression 50*a*, multiple band-shaped ribs that protrude slightly from the surface are formed at predetermined intervals in the width direction and extending lengthwise in the pull-out direction, in order to reduce friction with the paper P that moves along the second support surface SP2.

Next, the holding mechanism portion HK will be described. The holding mechanism portion HK according to this embodiment is configured as a structure provided in both the first stacker 40 and the second stacker 50. Accordingly, first, the structure in the first stacker 40 will be described, and then the structure in the second stacker 50 will be described. Then, the configuration of the holding mechanism portion HK will be described using a state in which the second stacker 50 has been pulled out from the first stacker 40.

Figure 3A:
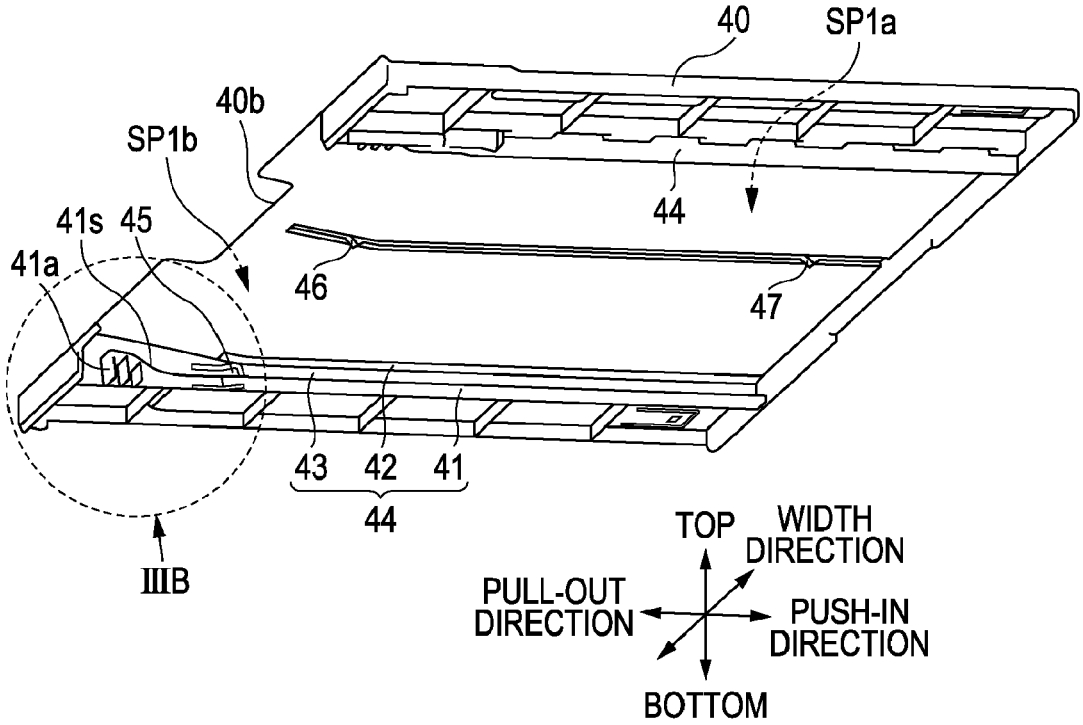
FIGS. 3A and 3B are diagrams illustrating a first stacker, where

First, the structure in the first stacker 40 will be described with reference to FIGS. 3A and 3B. FIG. 3A is a perspective view, viewing the first stacker 40 from an angle from below, whereas FIG. 3B is a partial bottom view of the area in FIG. 3A indicated by the arrow IIIB (that is, the circular dash-line area) seen from below.

Figure 3B:
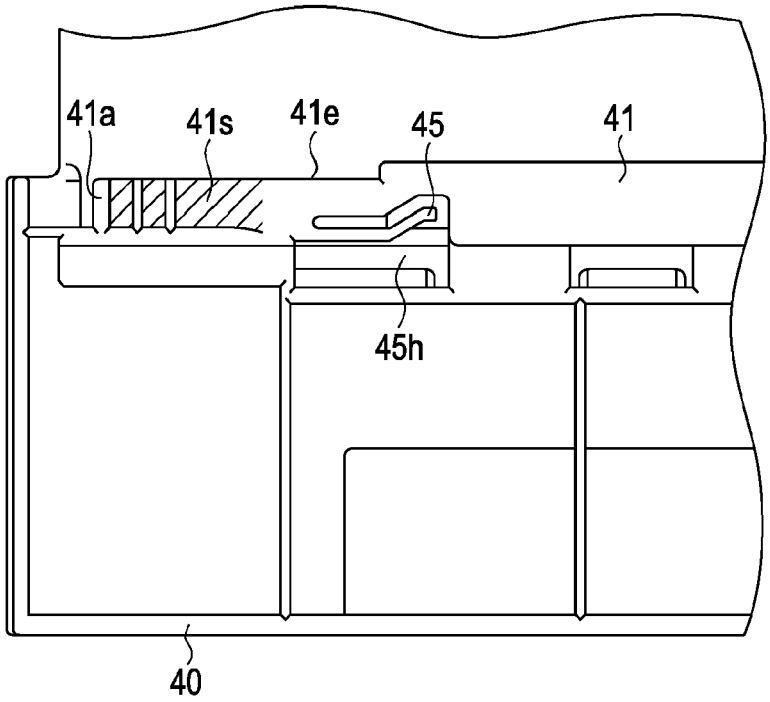

As shown in FIGS. 3A and 3B, approximately band-shaped guide plates 41, each having a flat surface that is parallel to the base-side support surface SP1*a* on the top surface side of the first support surface SP1, are provided, in locations that are on the outer sides of the rear surface of the first stacker 40 in the width direction, so as to extend from the base end (following end) of the first stacker 40 in the pull-out direction to locations that correspond approximately to the center of the leading edge-side support surface SP1*b* on the top surface side. In addition, an approximately band-shaped guide surface 42 that extends parallel to the guide plates 41 is provided on the lower surface (the rear surface) of the first stacker 40 so as to oppose the guide plates 41 from above in the thickness direction. Guide ribs 43 having wall surfaces in the upper and lower directions are provided along the pull-out direction so as to connect the guide plates 41 and the guide surface 42 to each other on the outer sides of their band shapes in the width direction. In this embodiment, concave-shaped, horizontally-oriented guide rails 44 having openings that point toward the center in the width direction are configured by the guide plates 41, the guide surface 42, and the guide ribs 43. The guide rails 44 are formed as a pair having a predetermined interval therebetween in the width direction of the first stacker 40 that essentially corresponds to the dimensions of the second stacker 50 in the width direction, and are configured so as to have a region that overlaps, in a planar manner, with part of the second stacker 50 in the width direction. Accordingly, the second stacker 50 is capable of being pulled out, pushed in, and so on along the guide rails 44. Note that shaft-shaped projections 51 and 52 (mentioned later; see FIGS. 4A and 4B) provided on both side surfaces of the second stacker 50 slide within these respective guide rails 44.

In each of the guide plates 41, a rising sloped portion 41*s* (in FIG. 3B, the area on the opposite side of the hatched area in the orthogonal direction of the paper) is formed so as to continue from the planar portion of the guide plates 41 that extends from the base end of the guide plates 41 to the leading end of the guide plates 41, so that a leading edge region 41*e*, having a predetermined length, rises toward the front in the pull-out direction and approaches the leading edge-side support surface SP1*b*, which is sloped upward on the upper surface side. Reinforcing ribs 41*a* (three, in FIGS. 3A and 3B), for suppressing the guide plate 41 (the sloped portion 41*s*) from deforming (bending) in the downward direction, are formed in the spatial region formed below the sloped portion 41*s* due to the leading edge region 41*e* of the guide plate 41 rising. Note that in each of the guide plates 41, the leading edge region 41*e* that forms this sloped portion 41*s* is formed at a narrower width than the other areas (the planar areas) of the guide plate 41 through cutouts on both sides of the guide plate 41 in the width direction, so that a sufficient space for the second stacker 50 to pass during pull-out and push-in along the guide rails 44 can be secured. Doing so makes it possible to store the second stacker 50 within the first stacker 40, with the second stacker 50 passing between the pair of sloped portions 41*s* without interference and the portions of the second stacker 50 that overlap in a planar manner with the guide plates 41 in the width direction (that is, the shaft-shaped projections 51 and 52) moving while being supported.

Furthermore, in a location of the guide rib 43 that is before the area corresponding to the sloped portion 41*s* (in the opposite direction of the pull-out direction), a contact portion 45, configured of a cantilever-shaped elastic portion formed in a bent shape by having its surrounding area cut out, is formed so that its leading edge area angles outward from the wall surface of the guide rib 43, and inward in the width direction, by a predetermined amount. In this embodiment, this contact portion 45 is formed so that its bent-shaped leading side is flexible, by providing a cut in the constituent member of the guide rail 44 (that is, the guide rib 43). Note that in order to form the contact portion 45 configured of a cantilever-shaped elastic portion using die cutting, an opening 45*h* (see FIG. 3B) for die cutting is formed in a location of the first stacker 40 that corresponds to the contact portion 45.

Figure 5A:
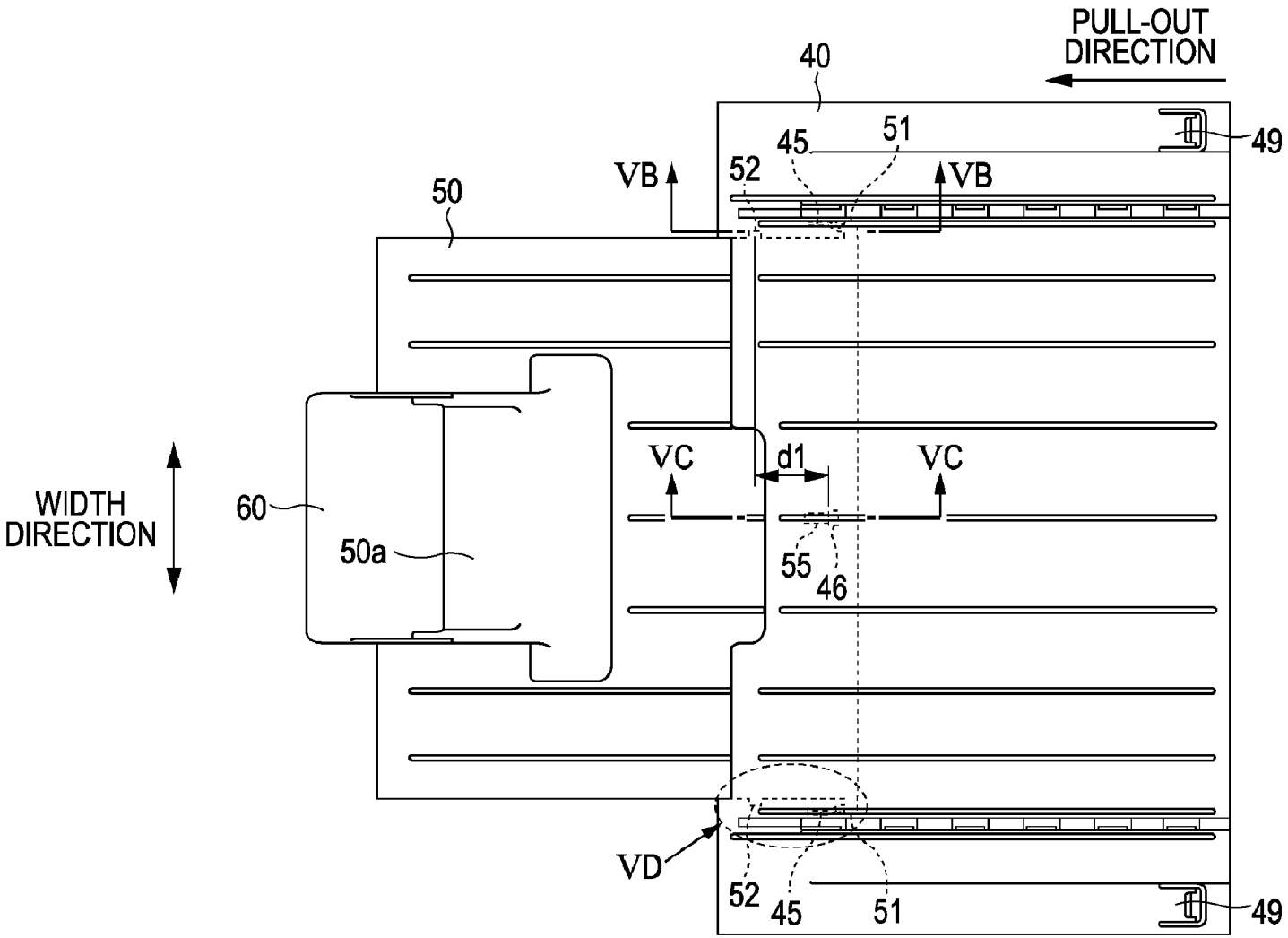
FIGS. 5A, 5B, 5C, and 5D are descriptive diagrams illustrating a holding mechanism portion, where
Figure 5B:
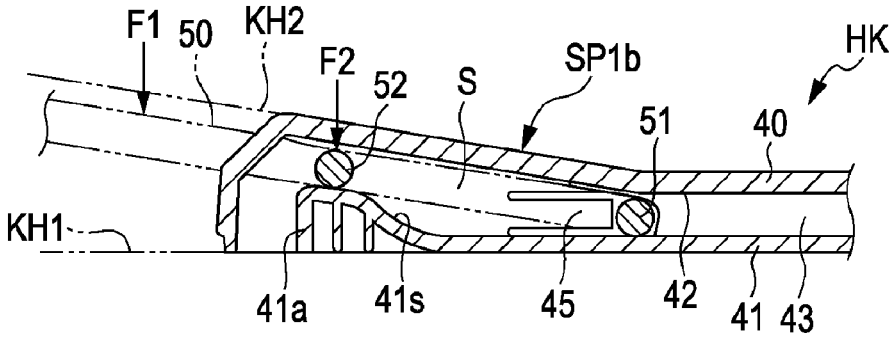

Furthermore, in this embodiment, the sloped portion 41*s*, the contact portion 45, and so on are formed within the spatial region that corresponds to the near side of the leading edge-side support surface SP1*b* of the first support surface SP1. In other words, these portions are formed within a spatial region S, which, when the first stacker 40 is viewed from above, is located within the outer boundaries of the first stacker 40 and between an imaginary plane KH1 that contains a base surface parallel to the base-side support surface SP1*a* in the first stacker 40 (that is, the lower surface of the guide plates 41) and an imaginary plane KH2 that contains the leading edge-side support surface SP1*b*, as shown in FIG. 5B. Accordingly, the rear surface side of the first stacker 40 has an essentially flat bottom surface shape in which nothing protrudes in the downward direction from the first stacker 40 that includes the guide plates 41, including the multiple reinforcing ribs 41*a* that are formed.

Furthermore, as shown in FIG. 3A, a first projection (first interlocking portion) 46 and a second projection 47 are formed in what is essentially the center of the first stacker 40 in the width direction, in the rear surface thereof that is on the side opposite to the first support surface SP1. A single first projection 46 is provided in a location, toward the front in the pull-out direction, that corresponds to the location in the pull-out direction of the contact portion 45 that is cut out from the guide rib 43, whereas a single second projection 47 is provided in a location, toward the rear in the pull-out direction, that corresponds to the location in the pull-out direction that the stoppers 49 are provided in on the front surface side. Accordingly, the second projection 47 is formed in a location where, when the second stacker 50 is pushed into and stored on the rear surface side of the first stacker 40, the second projection 47 makes contact in an essentially flat manner in the pull-out direction with a projection (second interlocking portion) 55 (see FIGS. 4A and 4B) provided in the following end of the surface of the second stacker 50, in the center of the width direction thereof.

Figure 4A:
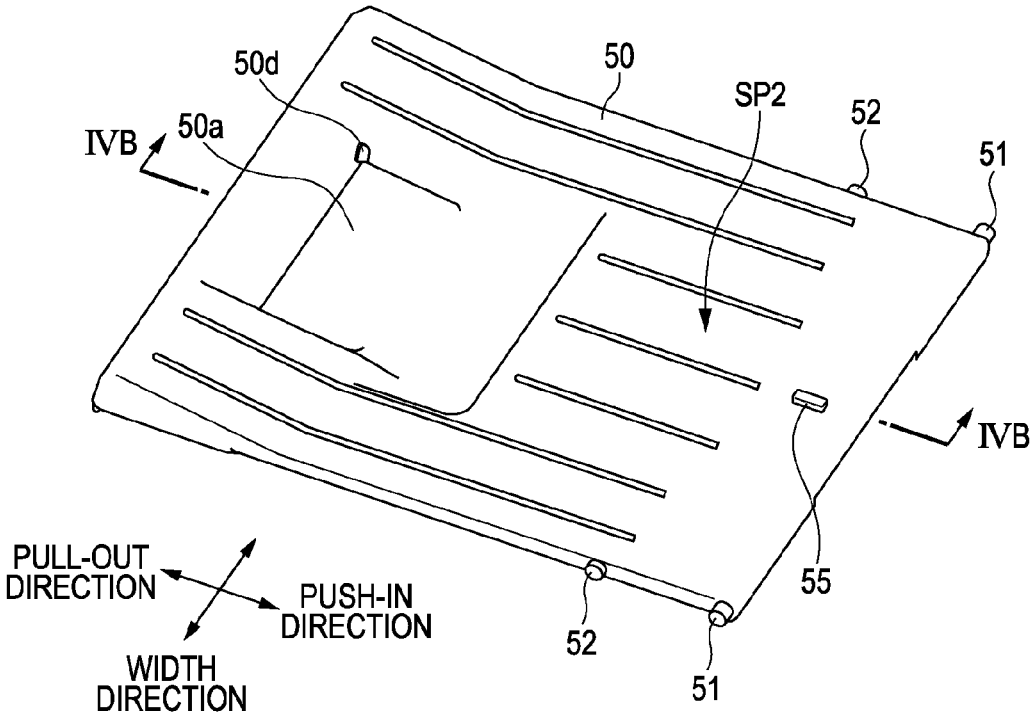
FIGS. 4A and 4B are diagrams illustrating a second stacker, where

Next, the structure of the second stacker 50 will be described with reference to FIGS. 4A and 4B. FIG. 4A is a perspective view of the second stacker 50 seen from above, whereas FIG. 4B is a cross-sectional view taken along the IVB-IVB line shown in FIG. 4A.

Figure 4B:
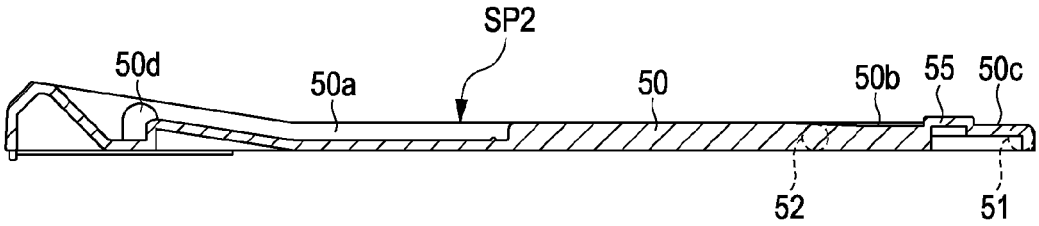

As shown in FIGS. 4A and 4B, two each of the shaft-shaped projections 51 and 52 are formed, protruding outward in the width direction, from both side surfaces of the second stacker 50 in the width direction, which is the direction that is orthogonal to the pull-out direction and that follows the second support surface SP2. In other words, the longer base end shaft-shaped projections 51 are erected from the side surfaces at the base end (following end) in the pull-out direction, and the shorter leading end shaft-shaped projections 52 are erected from locations that are a predetermined distance toward the leading end in the pull-out direction from the base end shaft-shaped projections 51 (specifically, the distance between what is approximately the center of the top surface of the sloped portion 41*s* and the leading edge of the contact portion 45). To rephrase, the base end shaft-shaped projections 51 extend further outward from the side surfaces than the leading end shaft-shaped projections 52. As mentioned earlier, these two shaft-shaped projections 51 and 52 are guided by and slide along the pair of guide rails 44 provided in the first stacker 40 when the second stacker 50 is pulled out from the first stacker 40.

Furthermore, a projection 55 that extends outward relative to the planar area of the second stacker 50 is formed in the second stacker 50, in a location that is toward the following end of the second stacker 50 in the pull-out direction and that is approximately in the center of the surface of the second stacker 50 in the width direction. As shown in FIG. 4B, by forming this projection 55, a first recessed area 50*b* is formed in front of the projection 55 in the pull-out direction and a second recessed area 50*c* is formed in back of the projection 55 in the pull-out direction. Meanwhile, while the second stacker 50 is being pulled out from the first stacker 40, the first projection 46 formed toward the front of the first stacker 40 passes over the projection 55 formed in the second stacker 50 from the first recessed area 50*b* and then fits with the second recessed area 50*c* located thereafter; this regulates the movement of the second stacker 50 in the push-in direction. Note that at this time, while the first projection 46 is passing over the projection 55, at least one of the first stacker 40 and the second stacker 50 bends, and once the first projection 46 has passed over the projection 55, that bending is restored to the original state.

Furthermore, while the second stacker 50 is being stored behind the rear surface of the first stacker 40, the second projection 47 formed toward the back of the first stacker 40 passes over the projection 55 formed in the second stacker 50 from the second recessed area 50*c* and then fits with the first recessed area 50*b* in front thereof; this regulates the movement of the second stacker 50 in the pull-out direction. Note that at this time, while the second projection 47 is passing over the projection 55, at least one of the first stacker 40 and the second stacker 50 bends, and once the second projection 47 has passed over the projection 55, that bending is restored to the original state.

As a result, a locking sound, or a "click", caused by the first projection 46 and the second projection 47 passing over the projection 55 and then interlocking with the first recessed area 50*b* or the second recessed area 50*c*, can be heard by a user when the user pulls out or pushes in the second stacker 50.

Figure 5C:
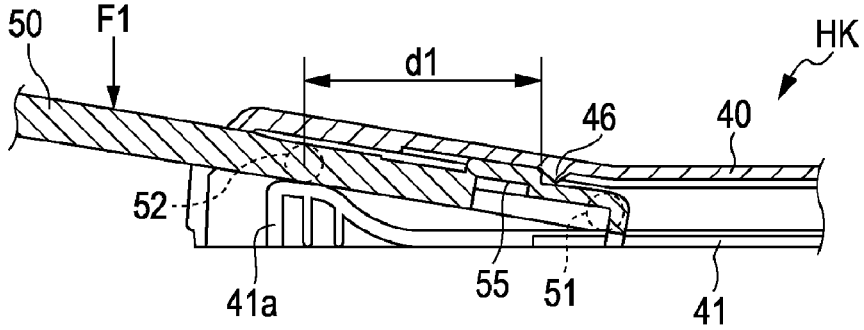
Figure 5D:
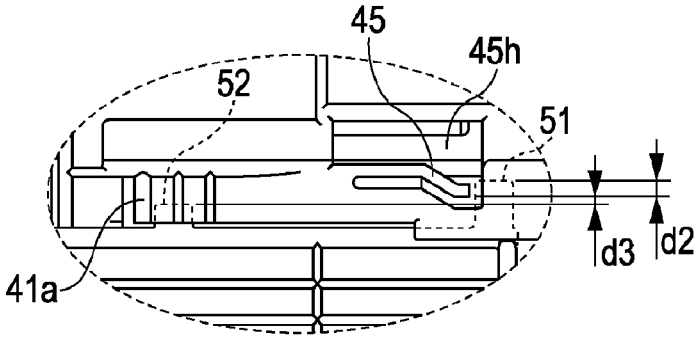

The configuration of the holding mechanism portion HK, which functions based on the manner in which the interlocking mechanism is formed in the first stacker 40 and the second stacker 50, will now be described with reference to FIGS. 5A to 5D. FIGS. 5A through 5D illustrate a state in which the second stacker 50 has been pulled out from the first stacker 40; FIG. 5A is a plan view of the stackers from above, FIG. 5B is a cross-sectional view taken along the VB-VB line in FIG. 5A, and FIG. 5C is a cross-sectional view taken along the VC-VC line illustrated in FIG. 5A. FIG. 5D is a partial bottom view seen from below of the oval dash-line area indicated by the arrow VD in FIG. 5A. Of these, FIGS. 5B and 5C in particular are diagrams illustrating the configuration of the holding mechanism portion HK.

As shown in FIGS. 5A through 5D, when pulled out, the movement of the second stacker 50 in the pull-out direction is regulated by the longer base end shaft-shaped projections 51 interlocking (making contact) in the pull-out direction with the leading ends of the contact portions 45 that face toward the back. At this time, as shown in FIG. 5B, the shorter leading end shaft-shaped projections 52 provided toward the front in the pull-out direction pass toward the front of the position in which the contact portions 45 are formed in the pull-out direction without interlocking with the contact portions 45, after which the base end shaft-shaped projections 51 make contact with the contact portions 45, regulating the movement; in this state, the shorter leading end shaft-shaped projection 52 is lifted in the upward direction by the sloped portions 41*s* provided in the guide plates 41. Meanwhile, the movement of the base end shaft-shaped projections 51 in the upward direction is regulated by the guide surface 42, and the base end shaft-shaped projections 51 are positioned at the flat portion of the guide plates 41 so as not to be lifted upward. Accordingly, the forward end of the second stacker 50 in the pull-out direction is lifted upward relative to the first stacker 40, and the second support surface SP2 is held approximately parallel to the leading edge-side support surface SP1*b* in the first support surface SP1 of the first stacker 40. To rephrase, the sloped portions 41*s* are formed so that the second support surface SP2 is approximately parallel to the leading edge-side support surface SP1*b* in the first support surface SP1.

Note that the three reinforcing ribs 41*a* are provided below the sloped portions 41*s* as mentioned earlier, using the space created below the sloped portions 41*s* due to the lifting. As a result, as shown in FIG. 5B, even if a load F2 is exerted on the leading end shaft-shaped projections 52 due to a force F1 caused by the weight of the stacked paper P being exerted on the second stacker 50, in terms of strength, the first stacker 40 is capable of withstanding the load to a sufficient degree.

Furthermore, as shown in FIG. 5C, when the second stacker 50 has been pulled out, the projection 55 provided in the second stacker 50 makes contact and interlocks with the first projection 46 provided in the first stacker 40 from the forward side. As a result, the second stacker 50 is prevented from moving in the direction opposite to the pull-out direction, and is thus held in the pulled-out state.

Accordingly, as can be seen from FIGS. 5B and 5C, the holding mechanism portion HK is primarily configured of the guide plates 41 (sloped portions 41*s*), the guide surface 42, the contact portions 45, and the first projection 46 provided in the first stacker 40, and the base end shaft-shaped projections 51, the leading end shaft-shaped projections 52, and the projection 55 provided in the second stacker 50.

Here, in this embodiment, as shown in FIG. 5A, the projection 55 and the first projection 46 are formed so that the planar location at which those projections come into contact with each other is a location that is a predetermined distance d1 in the pull-out direction from the location of the center of the leading end shaft-shaped projections 52. Thus, as shown in FIG. 5C, when a force F1 has been exerted on the second support surface SP2 due to the weight of the stacked paper P, the projection 55 is raised upward with the leading end shaft-shaped projections 52 serving as the rotational center; therefore, the degree to which the projection 55 interlocks with the first projection 46 is increased.

In this manner, when a load is applied to the second stacker 50, such as in the case where a force F1 is exerted due to the stacked paper P, a certain load is exerted upon the base end shaft-shaped projections 51 and the leading end shaft-shaped projections 52. Accordingly, it is necessary for the guide rails 44 to be of a strength, at the area at which the base end shaft-shaped projections 51 and the leading end shaft-shaped projections 52 are located when the second stacker 50 has been pulled out, that can withstand the load placed thereupon through the base end shaft-shaped projections 51 and the leading end shaft-shaped projections 52.

Incidentally, in this embodiment, the areas of the guide rails 44 in which the contact portions 45, which are configured of elastic members, are located have a lower degree of mechanical strength. This is due to the contact portions 45 being formed as cuts in the guide ribs 43, which are constituent elements of the guide rails 44, as described above. In consideration of this, in this embodiment, the contact portions 45 regulate the movement of the second stacker 50 in the pull-out direction by interlocking with the longer base end shaft-shaped projections 51 toward the following side in the pull-out direction, and thus are located forward from the base end shaft-shaped projections 51 in the pull-out direction, as shown in FIGS. 5A and 5D. Accordingly, cuts are not formed in the guide rails 44 in the positions at which the base end shaft-shaped projections 51 are located. As a result, the guide rails 44 have a sufficient mechanical strength with respect to loads exerted thereon through the base end shaft-shaped projections 51.

Furthermore, because the shorter leading end shaft-shaped projections 52 that are located forward in the pull-out direction pass over the contact portions 45 without interlocking therewith, the contact portions 45 are located further backward in the pull-out direction than the leading end shaft-shaped projections 52. Accordingly, with respect to loads exerted through the leading end shaft-shaped projections 52, the guide rails 44 are capable of withstanding loads exerted thereupon through the leading end shaft-shaped projections 52 to a sufficient degree, due not only to no cuts being formed therein, but also due to the reinforcement provided by the reinforcing ribs 41*a* as described above.

It should be noted that in this embodiment, as shown in FIG. 5D, the contact portions 45 and the base end shaft-shaped projections 51 are set to interlock with each other by an amount (in FIG. 5D, a length d2) that takes into consideration of error in the dimensions of the first stacker 40 and the second stacker 50 in the width direction, so that the contact portions 45 and the base end shaft-shaped projections 51 interlock (make contact) with each other with certainty. Accordingly, in the case where, for example, the stacker 100 is assembled by first inserting the second stacker 50 into the first stacker 40 from the direction that is opposite to the pull-out direction (that is, by putting the second stacker 50 in the stored state), the contact portions 45, which are configured of elastic members, are set so as to be capable of flexing by a predetermined amount toward the die-cutting openings 45*h* (here, an amount equivalent to the length d2), so that the contact portions 45 can pass the base end shaft-shaped projections 51 in the push-in direction. Furthermore, the leading end shaft-shaped projections 52 are also set so as to be separated by an amount (in FIG. 5D, a length d3) that takes into consideration of error in the dimensions of the first stacker 40 and the second stacker 50 in the width direction, so that the leading end shaft-shaped projections 52 do not interlock (make contact) with the contact portions 45 when the second stacker 50 is pulled out.

According to the embodiment described thus far, the following effects can be achieved.

(1) During use, when the second stacker 50 has been pulled out from the first stacker 40, the second stacker 50 is held at a tilted orientation relative to the first stacker 40, and thus the footprint of the stacker 100 in the horizontal direction can be reduced. In addition, during use, even if the leading edge-side support surface SP1*b* of the first support surface SP1 in the first stacker 40 and the second support surface SP2 in the second stacker 50 form, for example, a delivery area having a joint, the support surfaces do not intersect with each other at an angle at that delivery area; instead, the support surfaces SP1*b* and SP2 form a connection that extends within the same plane. On the other hand, even if the base-side support surface SP1*a* and the leading edge-side support surface SP1*b* of the first support surface SP1 in the first stacker 40 form, for example, a delivery area in which those support surfaces intersect at an angle, those support surfaces SP1*a* and SP1*b* are connected in a continuous curved manner, rather than a joint being formed between the two surfaces at the delivery area. Accordingly, the discharged paper P moves without any increase in resistance at the delivery area at which the leading edge of the paper P moves from the base-side support surface SP1*a* to the leading edge-side support surface SP1*b* in the first support surface SP1 of the first stacker 40 and at the delivery area at which the leading edge of the paper P moves from the leading edge-side support surface SP1*b* to the second support surface SP2 of the second stacker 50. Accordingly, the discharged paper P can be stacked in a stable manner by causing the paper P to move along the support surfaces SP1 (SP1*a*, SP1*b*) and SP2 of the stacker 100 in a smooth manner, while also achieving a reduction in size.

(2) The holding mechanism portion HK is formed within the spatial region S, which, when the first stacker 40 is viewed from above, is located within the outer boundaries of the first stacker 40 and between the imaginary plane KH1 that contains the base surface of the first stacker 40 and the tilted imaginary plane KH2 that contains the leading edge-side support surface SP1*b*; therefore, the holding mechanism portion HK does not protrude downward further than the base surface of the first stacker 40. Accordingly, in the case where the configuration is such that the first stacker 40 is capable of being pulled out from the printer 11 and pushed into and stored within the printer 11, there is no risk that the holding mechanism portion HK will catch when the first stacker 40 is being pulled out or pushed in.

(3) The support surfaces that are sloped in stages in the discharge direction reduce the discharge speed of the paper P in the discharge direction in stages, which makes it possible to stack the paper P in a stable manner.

(4) The paper P that is discharged from the printer 11 first moves in the horizontal direction along the base-side support surface SP1*a* of the first support surface SP1, and can therefore be discharged from the printer 11 in a smooth manner.

Second Embodiment

Next, a second embodiment will be described. In the aforementioned first embodiment, the structure is such that in the case where the support surfaces that support the paper P are formed by completely pulling out the second stacker 50 and the third stacker 60, the second support surface SP2 of the second stacker 50 is held approximately parallel to the leading edge-side support surface SP1*b* provided in the forward region 40*a* of the first stacker 40. As opposed to this, this embodiment assumes a case in which support surfaces are formed in a connected manner while the second stacker 50 is stored within the first stacker 40, without being pulled out therefrom. This situation corresponds to, for example, a case in which paper P of a small planar size is to be stacked.

Figure 6A:
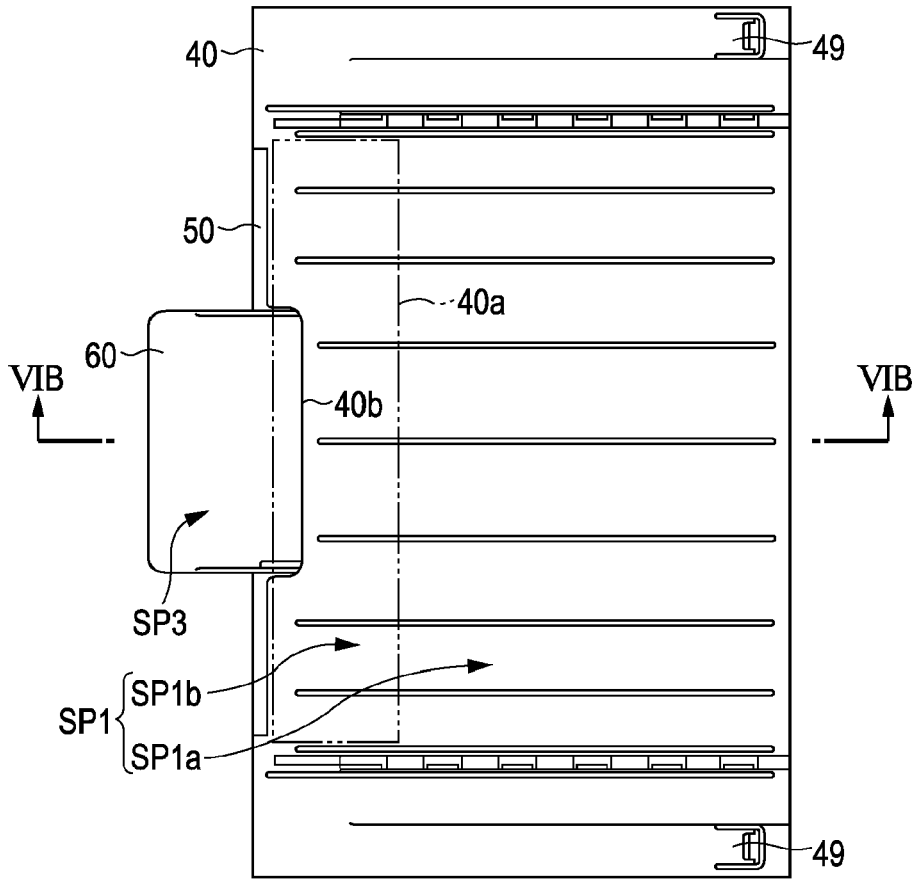
Figure 6B:
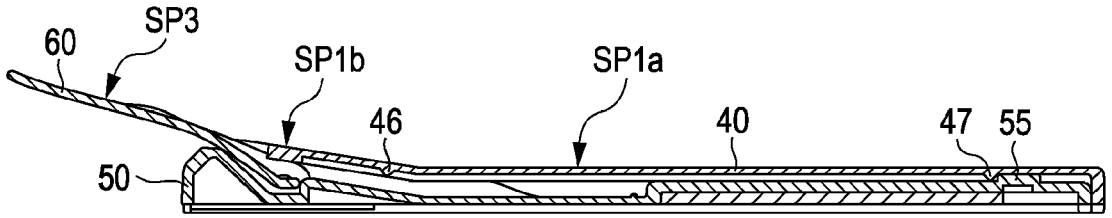
FIG. 6B is a cross-sectional view taken along the VIB-VIB line in FIG. 6A.

This embodiment will now be described using FIGS. 6A and 6B. FIG. 6A is a plan view illustrating the stacker 100 from above, where the second stacker 50 is in a stored state. FIG. 6B is a cross-sectional view taken along the VIB-VIB line shown in FIG. 6A.

As shown in FIG. 6A, in this embodiment, in a state in which the second stacker 50 is pushed into and stored within the first stacker 40, the third stacker 60, which has been pulled out from the second stacker 50 into an opened orientation by rotating the third stacker 60, does not interfere with the first stacker 40. In other words, a cutout 40*b* is formed so that the forward end portion of the first stacker 40 in the pull-out direction is distanced from the third stacker 60.

Furthermore, as shown in FIG. 6B, the third support surface SP3 of the third stacker 60, which has been pulled out from the second stacker 50 through a rotational operation, is formed so as to be approximately parallel to, and forming a single plane with, the leading edge-side support surface SP1*b* formed in the forward region 40*a* of the first stacker 40. Incidentally, this embodiment corresponds to a case in which the angle $\alpha$ and the angle $\beta$ shown in FIG. 1 are approximately the same angle. Of course, the third stacker 60 is configured so as to be stored in the second stacker 50 through a rotational operation.

According to the second embodiment described thus far, the following effects can be achieved in addition to the effects (1) through (4) of the aforementioned first embodiment.

(5) By forming the third support surface SP3 of the third stacker 60 approximately parallel with and on the same plane as the leading edge-side support surface SP1*b* of the first stacker 40, the paper P can be moved along the delivery area between the leading edge-side support surface SP1*b* of the first support surface SP1 and the third support surface SP3 in a smooth manner. Furthermore, in the case where the discharged paper P has a small planar size, a small support surface can be formed in accordance with the size of the paper P; this makes it unnecessary to form the surface area of the support surface of the stacker 100 at a size greater than is needed. Accordingly, the paper P can be stacked in a small amount of space based on the size of the paper P, and can be stacked in a stable manner.

The aforementioned embodiments may be changed to the embodiments described hereinafter as well.

In the aforementioned embodiments, at least the pull-out direction of the second stacker 50 may be a different direction than the discharge direction of the paper P from the printer 11. For example, in the case where the paper P is to be moved in a direction different than the discharge direction and stacked after being discharged from printer 11, it is preferable for the second stacker 50 to be pulled out in this different direction and for the tilted leading edge-side support surface SP1*b* of the first stacker 40 to be thus formed.

In the aforementioned embodiments, the stacker may be a recording medium stacker that includes multiple stack members having the configurations of the first stacker 40 and the second stacker 50. For example, the structural relationship between the second stacker 50 and the third stacker 60 can be set to the same configuration as the structural relationship between the first stacker 40 and the second stacker 50 as described above. Incidentally, in this case, a support surface that is approximately parallel to the third support surface SP3 may be formed in the second stacker 50, in the delivery area between the second support surface SP2 and the third support surface SP3.

In the aforementioned embodiments, the first stacker 40, the second stacker 50, and the third stacker 60 may be configured through integral molding using a resin material. Alternatively, the stackers may be formed by connecting multiple resin members using adhesive, screws, or the like, rather than being configured in an integral manner.

In addition, the material is not limited to resin, and may instead be metal. Alternatively, these materials may be used in combination with each other.

In the aforementioned embodiments, the recording apparatus may be a laser printer, a direct thermal printer, or the like, rather than an ink jet printer.

In addition, although the paper P is used as the recording medium in the aforementioned embodiments, the recording medium is not particularly limited to the paper P; any material, such as a resin plate, a metal plate, or the like, may be used as the recording medium as long as it is a medium that can be stacked in the recording medium stacker.

Although the recording apparatus is embodied as an ink jet printer 11 in the aforementioned embodiments, a liquid ejecting apparatus that ejects or discharges a liquid aside from ink may be employed as the recording apparatus. The invention can also be applied in various types of liquid ejecting apparatuses including liquid ejecting heads that eject minute liquid droplets. Note that "droplet" refers to the state of the liquid ejected from the liquid ejecting apparatus, and is intended to include granule forms, teardrop forms, and forms that pull tails in a string-like form therebehind. Furthermore, the "liquid" referred to here can be any material capable of being ejected by the liquid ejecting apparatus. For example, any matter can be used as long as the matter is in its liquid state, including liquids having high or low viscosity, sol, gel water, other inorganic agents, organic agents, liquid solutions, liquid resins, and fluid states such as liquid metals (metallic melts); furthermore, in addition to liquids as a single state of a matter, liquids in which the particules of a functional material composed of a solid matter such as pigments, metal particles, or the like are dissolved, dispersed, or mixed in a liquid solvent are included as well. Ink, described in the above embodiment as a representative example of a liquid, liquid crystals, or the like can also be given as examples. Here, "ink" generally includes water-based and oil-based inks, as well as various types of liquid compositions, including gel inks, hot-melt inks, and so on. The following are specific examples of liquid ejecting apparatuses: liquid ejecting apparatuses that eject liquids including materials such as electrode materials, coloring materials, and so on in a dispersed or dissolved state for use in the manufacture and so on of, for example, liquid-crystal displays, EL (electroluminescence) displays, surface light emission displays, and color filters; liquid ejecting apparatuses that eject bioorganic matters used in the manufacture of biochips; liquid ejecting apparatuses that eject liquids to be used as samples for precision pipettes; printing equipment and microdispensers; and so on. Furthermore, the invention may be employed in liquid ejecting apparatuses that perform pinpoint ejection of lubrication oils into the precision mechanisms of clocks, cameras, and the like; liquid ejecting apparatuses that eject transparent resin liquids such as ultraviolet light-curable resins onto a substrate in order to form miniature hemispheric lenses (optical lenses) for use in optical communication elements; and liquid ejecting apparatuses that eject an etching liquid such as an acid or alkali onto a substrate or the like for etching. The invention can be applied to any type of these liquid ejecting apparatuses.

What is claimed is:

1. A recording medium stacker that supports and stacks a recording medium discharged from a recording apparatus, the stacker comprising:

a first stack member provided with a first support surface capable of supporting the recording medium; and a second stack member that is stored within the first stack member and can be pulled out of and pushed into the first stack member, and that is provided with a second support surface capable of supporting the recording medium when the second stack member has been pulled out of the first stack member and is in use, wherein the first stack member includes:

a base end support surface in which the first support surface has a planar shape at a base end of the first stack member in a pull-out direction of the second stack member; and a leading end support surface that is formed continuously from the base end support surface to a leading end of the first stack member such that a radial curve is formed at a junction of the base end support surface and the leading end support surface so as to form a connected curved support surface, the leading end support surface forming a planar shape in which the leading end of the first stack member in the pull-out direction is sloped upward due in part to the radial curve, and the second stack member is held in a tilted orientation in which the second support surface forms a planar shape, and when in use, continues to the leading end of the second support surface in a tilted state with the same upward slope as the leading end support surface of the first support surface.

2. The recording medium stacker according to claim 1, further comprising:

a holding mechanism portion that holds the second stack member in the tilted orientation when in use, wherein the holding mechanism portion is provided within a spatial region that, when the first stack member is viewed from above, is located within outer boundaries of the first stack member and between an imaginary plane that contains a base surface parallel to the base end support surface and an imaginary plane that contains the leading end support surface.

3. The recording medium stacker according to claim 1, further comprising:

a third stack member, having a plane-shaped third support surface that is smaller than the second support surface of the second stack member, provided so as to be pivotable, relative to the second stack member and central to the leading end of the second stack member, between a stored orientation in which the third support surface follows the second support surface and an opened orientation in which the third support surface continues to a leading end of the third support surface, and has a steeper slope to the leading end than the second support surface, wherein when the third stack member is in the opened orientation and the second stack member is stored within the first stack member, the third stack member continues to the leading end of the support surface of the third stack member in a tilted orientation in which the third surface is at the same upward slope toward the leading edge as the leading end support surface of the first support surface of the first stack member.

4. The recording medium stacker according to claim 1, wherein the leading end support surface is formed more downstream in a discharge direction of the recording medium than the base end support surface.

5. A recording apparatus comprising:

a recording unit that records onto a recording medium;

a discharge unit that discharges the recording medium that has been recorded onto; and the recording medium stacker according to claim 1.

6. A recording medium stacker that supports and stacks a recording medium discharged from a recording apparatus, the stacker comprising:

a first stack member provided with a first support surface capable of supporting the recording medium; and a second stack member that is stored within the first stack member and can be pulled out of and pushed into the first stack member, and that is provided with a second support surface capable of supporting the recording medium when the second stack member has been pulled out of the first stack member and is in use, wherein the first stack member includes:

a base end support surface in which the first support surface has a planar shape at a base end of the first stack member in a pull-out direction of the second stack member; and a leading end support surface that is formed continuously from the base end support surface so as to form a planar shape in which the leading end of the first stack member in the pull-out direction is sloped upward, and the second stack member is held in a tilted orientation in which the second support surface forms a planar shape, and when in use, continues to the leading end of the second support surface in a tilted state with the same upward slope as the leading end support surface of the first support surface, and a third stack member, having a plane-shaped third support surface that is smaller than the second support surface of the second stack member, provided so as to be pivotable, relative to the second stack member and central to the leading end of the second stack member, between a stored orientation in which the third support surface follows the second support surface and an opened orientation in which the third support surface continues to a leading end of the third support surface, and has a steeper slope to the leading end than the second support surface, wherein when the third stack member is in the opened orientation and the second stack member is stored within the first stack member, the third stack member continues to the leading end of the support surface of the third stack member in a tilted orientation in which the third surface is at the same upward slope toward the leading edge as the leading end support surface of the first support surface of the first stack member.

* * * * *